United States Patent [19]

Morse et al.

[11] 4,348,853

[45] Sep. 14, 1982

[54] CASE OPENING AND SEALING APPARATUS

[76] Inventors: Hugh B. Morse, 1840 Campbell Ave., San Jose, Calif. 95125; Helmut E. Masch, 764 Asbury St., San Jose, Calif. 95126

[21] Appl. No.: 176,507

[22] Filed: Aug. 8, 1980

[51] Int. Cl.[3] ..... B65B 7/20; B65B 43/30

[52] U.S. Cl. ..... 53/566; 53/374; 53/381 R; 53/571; 493/122; 493/126; 493/316

[58] Field of Search ..... 53/566, 381 R, 571, 53/374; 493/316, 317, 319, 120, 122–124, 126, 127

[56] References Cited

U.S. PATENT DOCUMENTS

| | | | |
|---|---|---|---|
| 2,906,075 | 9/1959 | Vogel | 53/381 R X |
| 2,993,314 | 7/1961 | Havemann et al. | 53/566 X |
| 3,060,659 | 10/1962 | Blais et al. | 53/566 |
| 3,300,947 | 1/1967 | Fahrenbach | 53/566 |
| 3,580,143 | 5/1971 | McIntyre | 493/313 |
| 3,701,525 | 10/1972 | Masch | 271/129 |
| 4,201,118 | 5/1980 | Calvert et al. | 493/125 |

FOREIGN PATENT DOCUMENTS

| | | | |
|---|---|---|---|
| 936466 | 11/1973 | Canada | 53/566 |

*Primary Examiner*—James F. Coan
*Assistant Examiner*—Charles L. Willis
*Attorney, Agent, or Firm*—Phillips, Moore, Lempio & Finley

[57] ABSTRACT

A case opening and sealing apparatus comprises a magazine having a plurality of flattened case blanks stacked therein, a conveyor underlying the magazine, and a plurality of suction cups for opening each case into tubular form for subsequent filling. Each forward case blank in the magazine is precisely ejected into proximity with the suction cups for opening purposes by a shuttle mechanism which functions to sequentially (1) engage a lower edge of the case blank to initially prevent removal thereof from the magazine, (2) move the case blank upwardly to release the lower edge thereof from the magazine, and (3) push the case blank downwardly onto the conveyor and into close proximity with the suction cups which function to open the case into tubular form.

10 Claims, 10 Drawing Figures

FIGURE 5
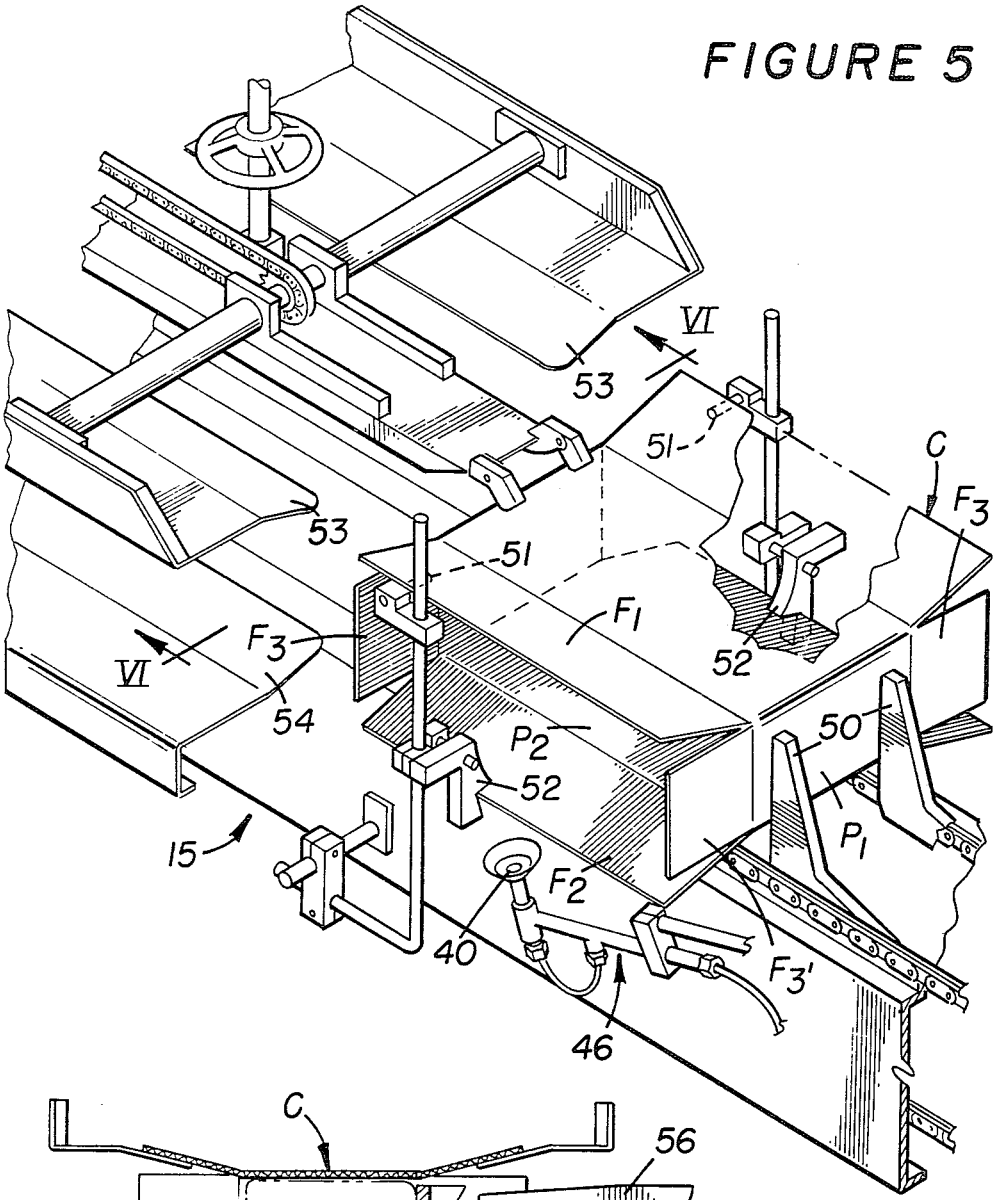
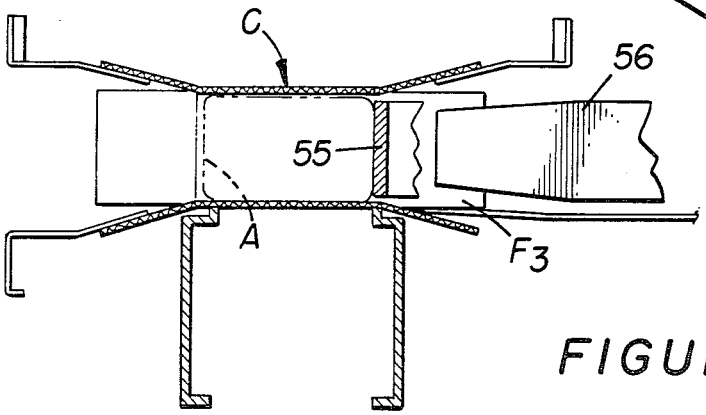
FIGURE 6

CASE OPENING AND SEALING APPARATUS

DESCRIPTION

CROSS-REFERENCE TO RELATED APPLICATION

This invention is directed to a case opening and sealing apparatus particularly usable with the "Case Loading Apparatus and Method" disclosed and claimed in Applicants' copending U.S. Patent Application Ser. No. 134,703, filed on Mar. 27, 1980.

TECHNICAL FIELD

This invention relates generally to a case opening and sealing apparatus and more particularly to an apparatus having a magazine and opening station for precisely opening flattened base blanks for the insertion of a plurality of articles therein.

BACKGROUND ART

Applicants' above-referenced U.S. patent application Ser. No. 134,703 discloses a case loading apparatus wherein a plurality of articles are inserted transversely through an open end of a case which is thereafter sealed for shipment purposes. This type of apparatus requires precise alignment of the opened case with the articles to be inserted therein, including the requirement that the flattened case be precisely fed onto a conveyor and opened prior to its conveyance through the filling, folding, and sealing stations of the apparatus.

The precise depositing of the cases onto a conveyor, from a magazine, raises a number of problems when the cases are composed of heavy-duty paperboard, such as corrugated paperboard. The combined problems of individually feeding the flattened blank from a magazine, positioning the blank on a conveyor, and thereafter opening the blank into tubular form, have sometimes made it necessary to resort to manual operations for effecting the same. Automated apparatus for performing these operations are often complex and do not always meet the speed requirements for a particular packaging machine.

DISCLOSURE OF INVENTION

The case opening and sealing apparatus of this invention comprises a magazine having a plurality of flattened case blanks stacked in upstanding relationship therein, a conveyor underlying the magazine, and opening means for sequentially opening the case blanks. The improved apparatus further comprises shuttle means for sequentially (1) engaging a lower edge of a leading one of the flattened case blanks to prevent removal thereof from the magazine, (2) moving the case blank upwardly to release the lower edge thereof from the magazine, and (3) pushing the case blank downwardly onto the conveyor whereat the blank is adapted to be opened into tubular form.

In another aspect of this invention, a folding and flap positioning station is provided for precisely folding the flaps of each case into open positions to adapt the case for insertion of a plurality of articles therein, and for thereafter folding the flaps prior to their passage through a flap sealing station.

BRIEF DESCRIPTION OF THE DRAWINGS

Other objects and advantages of this invention will become apparent from the following description and accompanying drawings wherein;

FIG. 5 is an isometric view illustrating movement of an opened case into a case flap positioning station whereat articles are inserted into each case;

FIG. 6 is a transverse sectional view, taken in the direction of arrows VI—VI in FIG. 5, illustrating means for holding flaps of the case in open positions to adapt the case for the insertion of articles therein;

BEST MODE OF CARRYING OUT THE INVENTION

General Description

Figure 1:
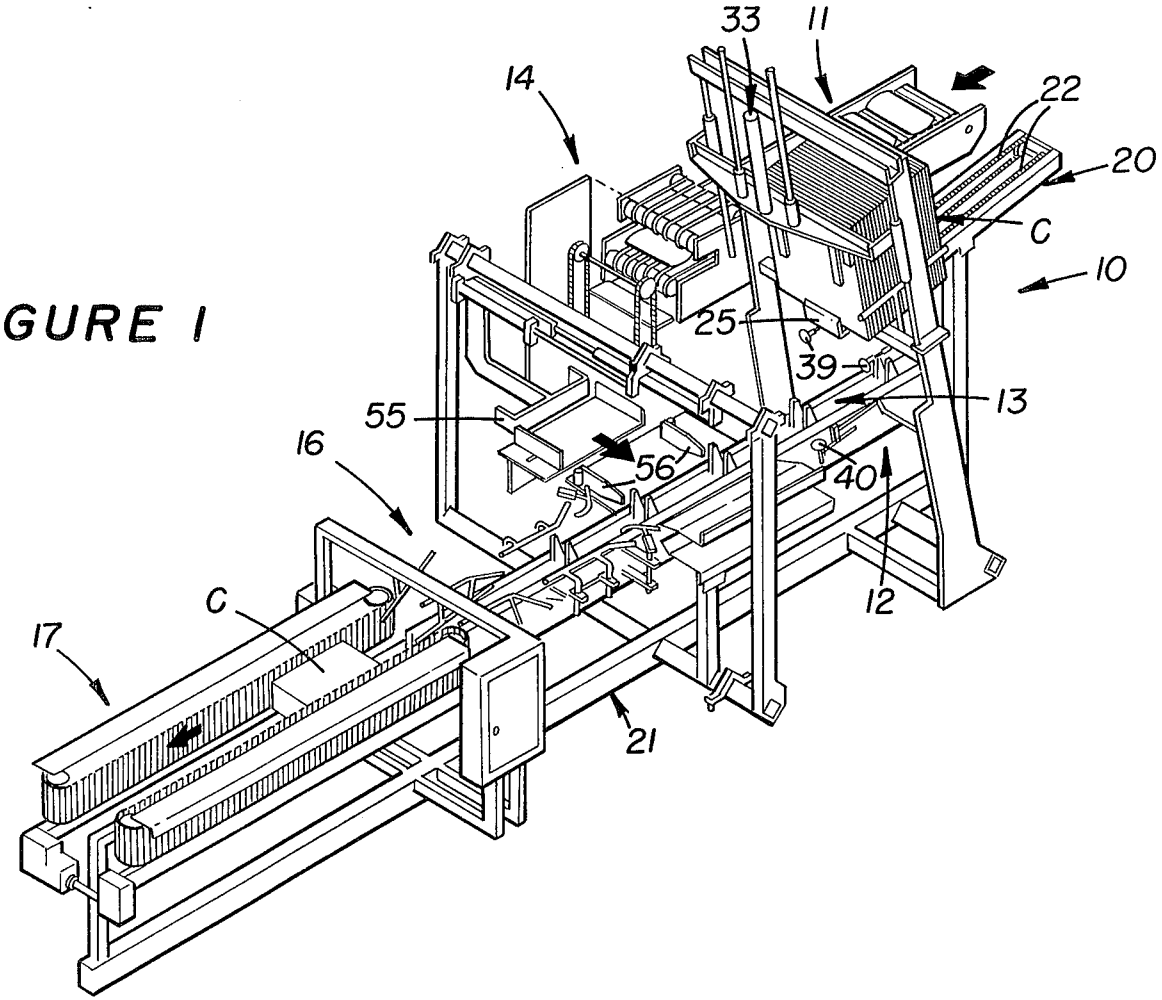
FIG. 1 is an isometric view illustrating a case opening and sealing apparatus embodying this invention.

FIG. 1 generally illustrates a case opening and sealing apparatus 10 comprising a case loading and magazine station 11 having a plurality of flattened case blanks C stacked in upstanding relationship therein. The case blanks are individually moved downwardly into a case opening station 12 whereat the case blank is opened into tubular form and deposited onto a conveyor 13, as shown in FIGS. 2-5. The intermittently-run conveyor will move the opened case blank to an article transfer and loading station 14 (FIGS. 5 and 6) whereat a plurality of stacked articles are inserted through an opened end of the case. The article transfer and loading station is the subject of applicants' copending U.S. patent application Ser. No. 134,703, referenced above.

Figure 8:
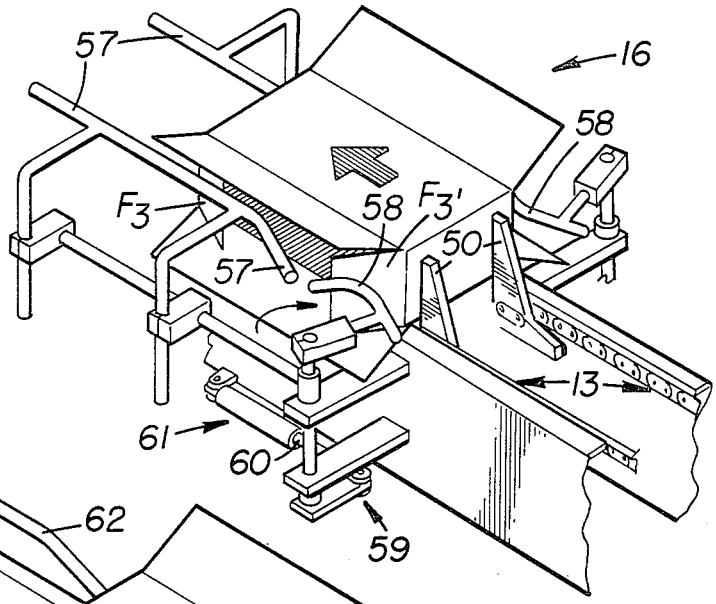
FIGS. 8–10 sequentially illustrate a filled case being moved through the case flap folding station, prior to its passage through the sealing station.
Figure 9:
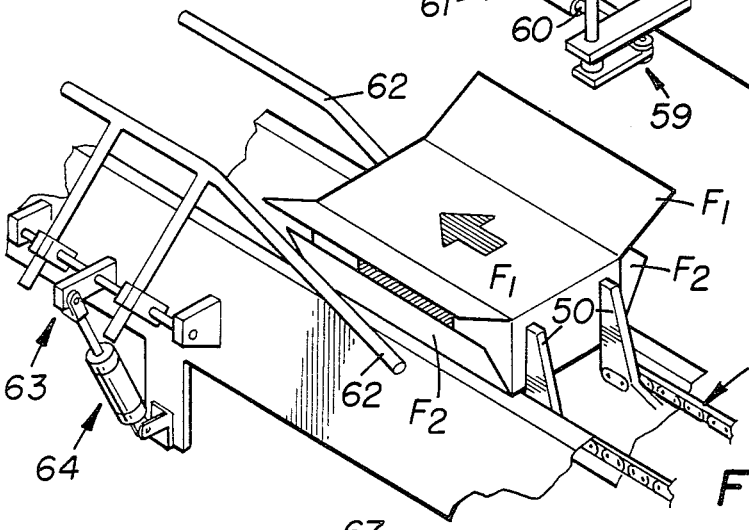
Figure 10:
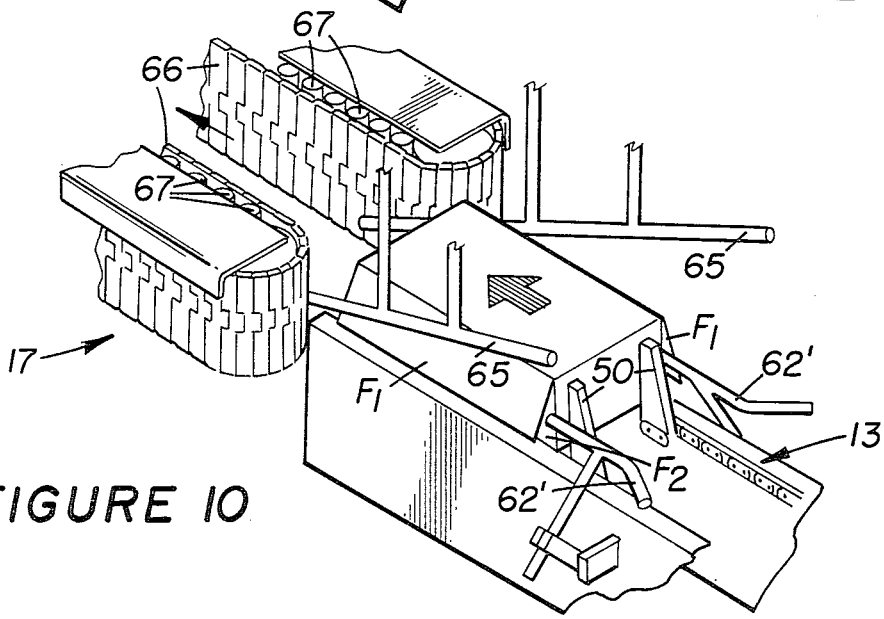

When the case has been stopped momentarily adjacent to the article transfer and loading station, a case flap positioning station 15 will function to precisely hold the case flaps in their opened positions, as shown in FIGS. 5 and 6. After the case has been filled with articles, conveyor 13 will then move the filled case generally leftwardly in FIG. 1 and through a case flap folding station 16, which functions to precisely fold the end flaps of the carton into superimposed relationship, as shown in FIGS. 8–10. Conveyor 13 will then carry the case through a sealing station 17 whereat the flaps are bonded together for shipment purposes. The flaps may have a suitable adhesive preapplied thereto, or standard glue guns or the like (not shown) may be employed in the apparatus in a conventional manner.

DETAILED DESCRIPTION

Figure 2:
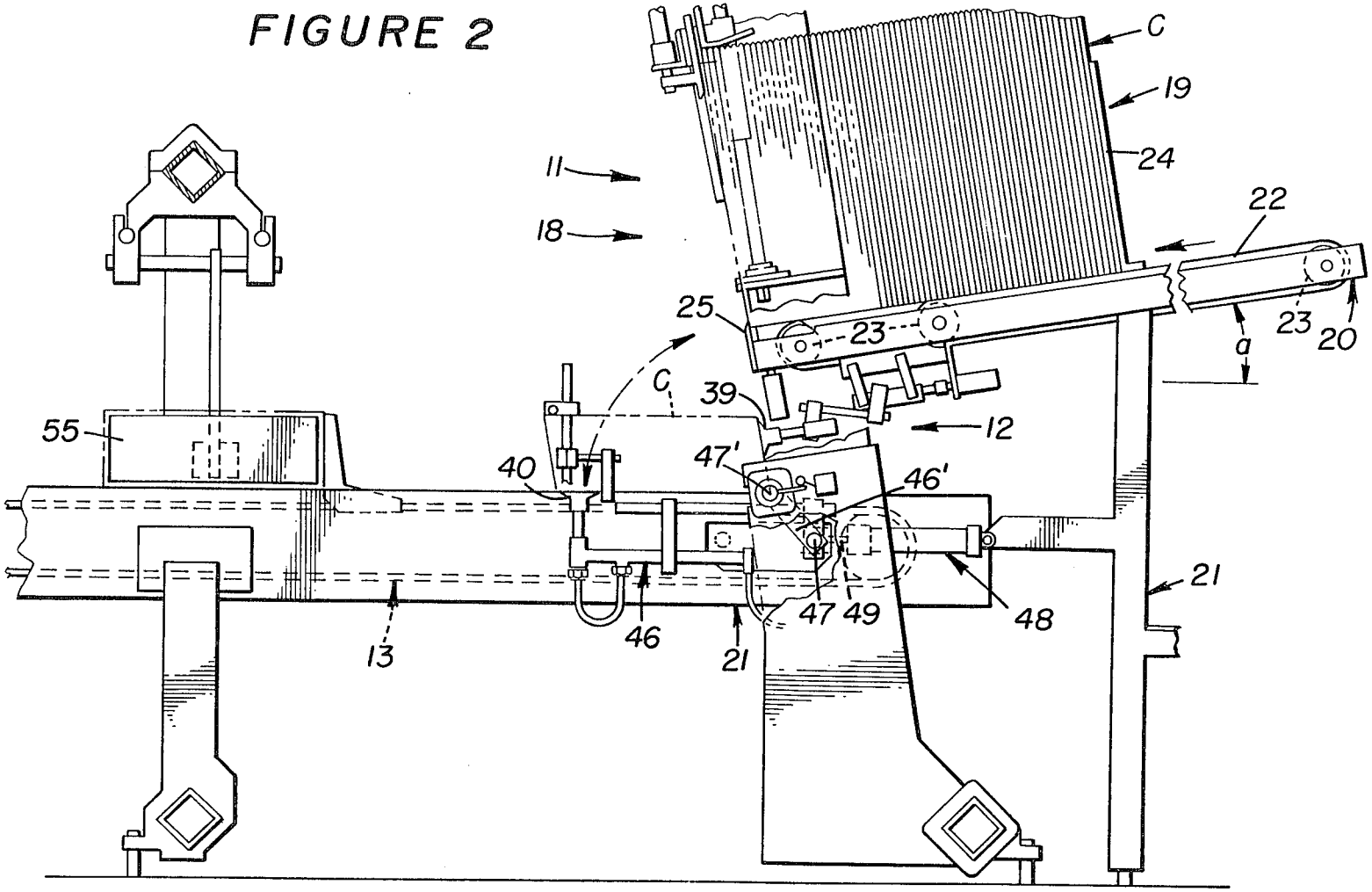
FIG. 2 is a side elevational view of a case loading and magazine station having a plurality of flattened case blanks stacked therein and adapted to have the blanks sequentially opened at a case opening station disposed therebelow.
Figure 3:
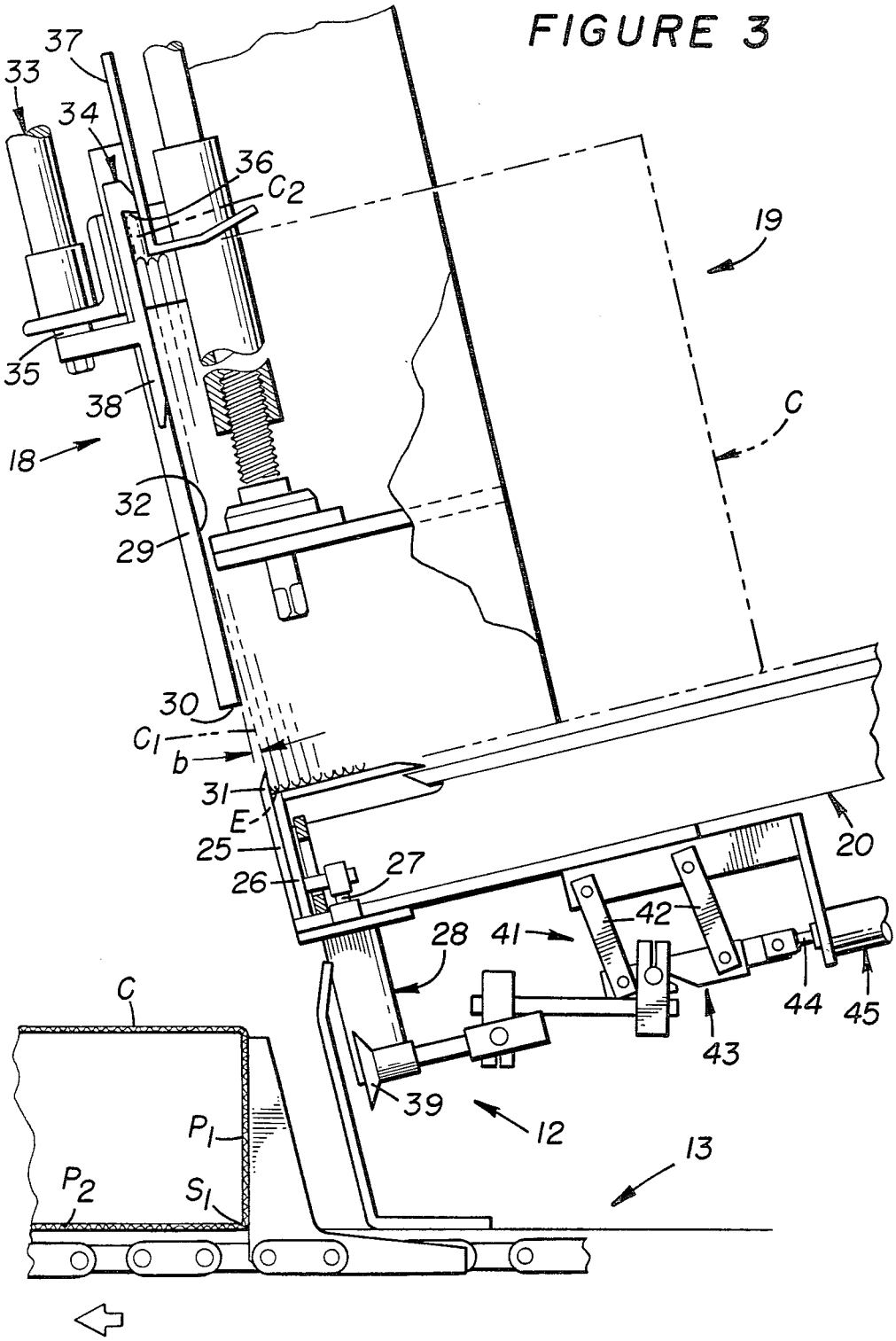
FIGS. 3 and 4 are partial side elevational views illustrating sequential steps employed for opening the case blanks into tubular form.

FIG. 2 illustrates case loading and magazine station 11 and case opening station 12. As shown in FIG. 3, shuttle means 18 will function for sequentially (1) engaging a lower edge E of a leading one of the case blanks $C_1$ to prevent removal thereof from a magazine 19, (2) moving the case blank from its position $C_1$ upwardly to a position $C_2$ to release lower edge E thereof from the magazine, and (3) pushing the case blank downwardly to position $C_3$ (FIG. 4) and onto conveyor 13. As described hereinafter, the case blanks enters opening station 12 in FIG. 4 whereat the case blank will be opened into tubular form, as illustrated in FIGS. 2 and 3.

Figure 4:
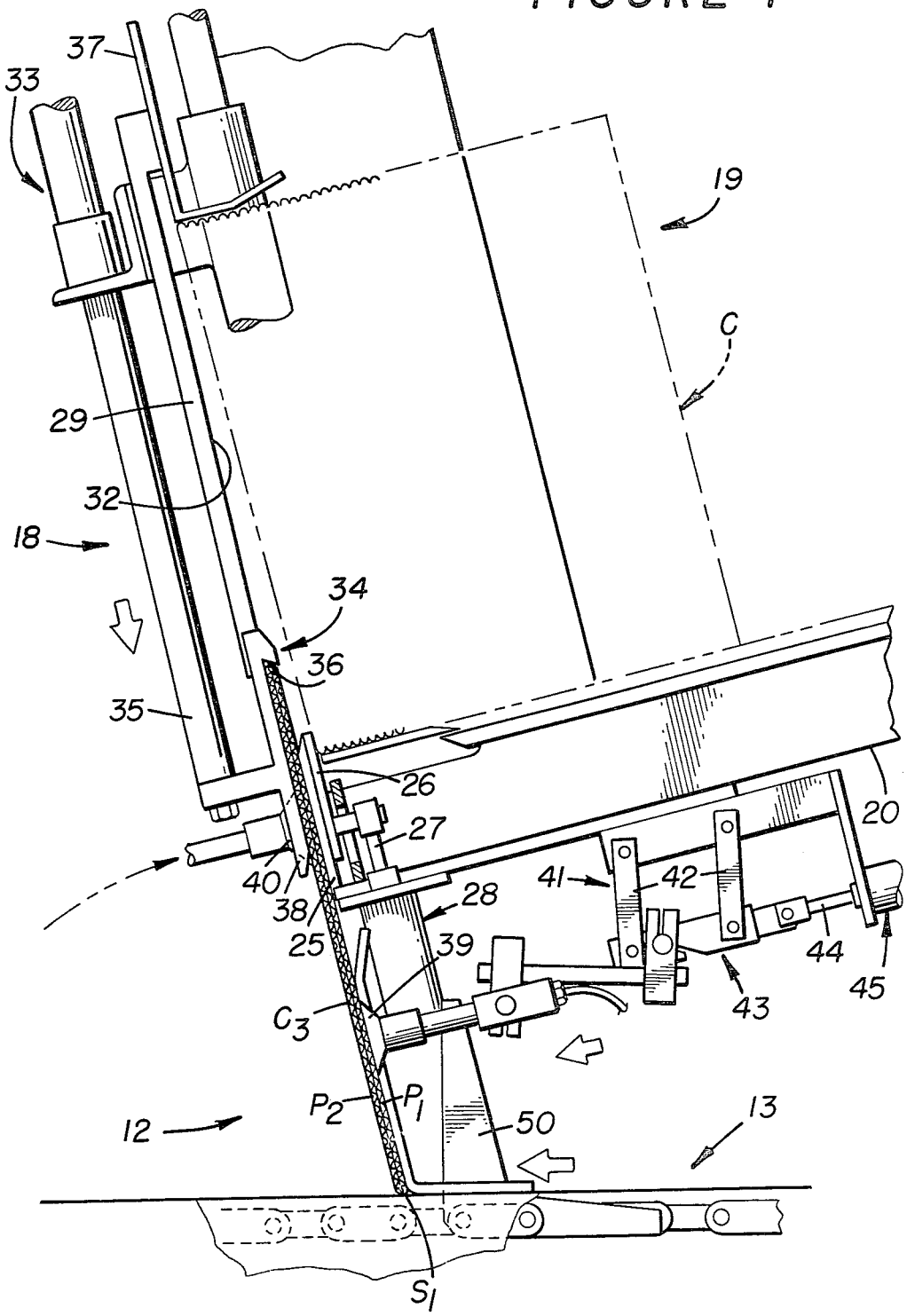
Figure 7:
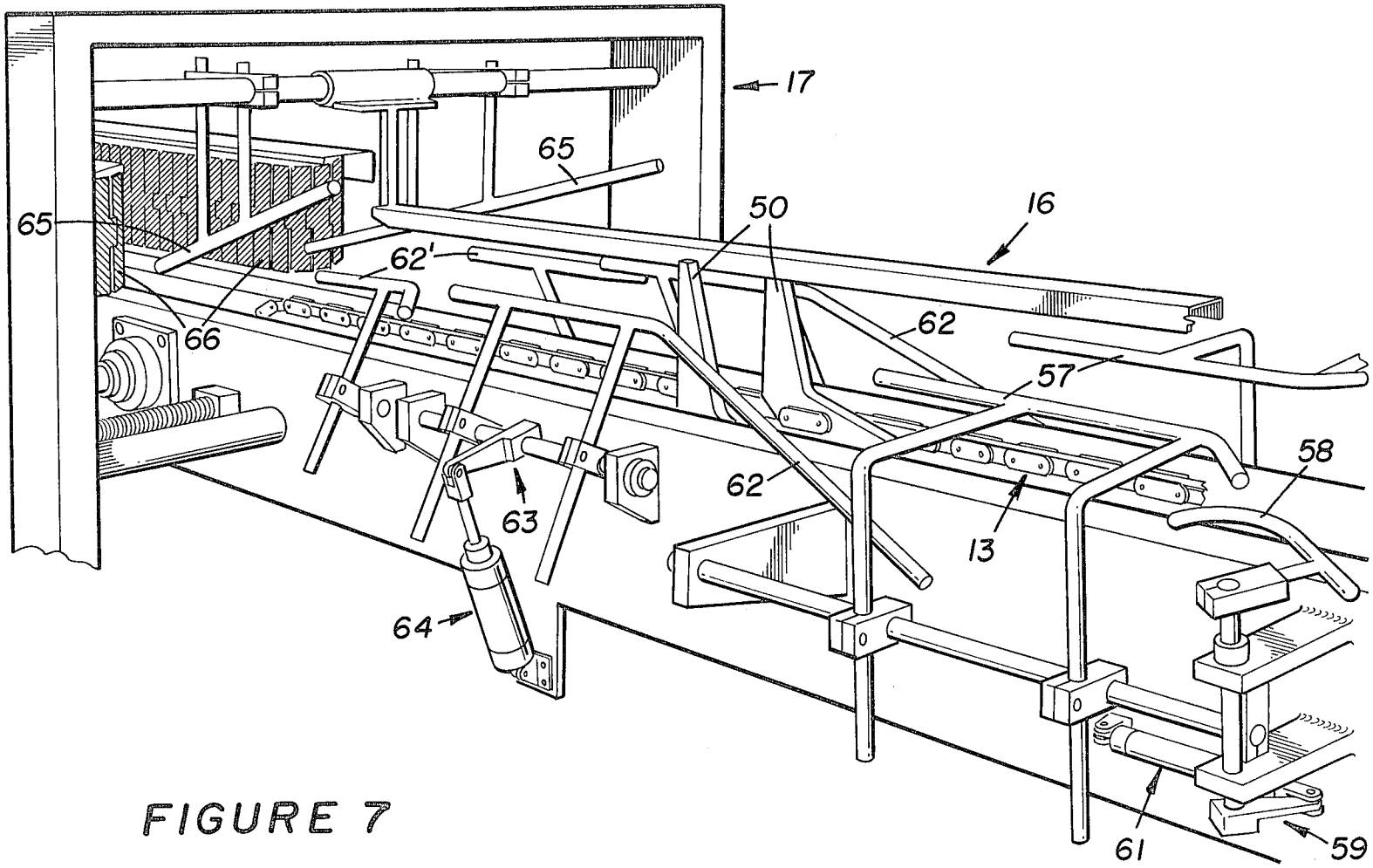
FIG. 7 is a perspective view of case flap folding and sealing stations of the apparatus.

Still referring to FIGS. 2–4, magazine 19 is mounted on a subframe 20, secured on a main frame 21 of apparatus 10. A pair of endless chains 22 are suitably mounted on sprockets or rollers 23, rotatably mounted on subframe 20, and have a backup or push plate 24 secured thereon. Flattened case blanks C are urged forwardly to engage end E of each forwardmost blank with a stop 25, secured on frame 20. It should be noted in FIG. 2 that frame 20 may be tipped forwardly to define an acute angle "a" relative to ground level to aid in urging the cases towards the forward end of magazine 19 and against stop 25. Chains 22 are driven at a relatively low linear speed to further aid in "crowding" the cases fowardly on the magazine.

As shown in FIG. 3, shuttle means 18 comprises a reciprocal plate 26 which abuts an inside surface of stop 25 which is formed as a stationary plate. Reciprocal plate 26 is secured to a rod 27 of a double-acting air cylinder 28 which functions to move the forwardmost case blank C from its $C_1$ position, illustrated in FIG. 3, to its raised $C_2$ position and above stop 25. An upper portion of the forwardmost blank engages a second stop or plate 29, secured on frame 20. A lower end 30 of plate 29 is spaced vertically above stop 25 to define an opening therebetween adapted to have the case blank inserted downwardly therethrough, as shown in FIG. 4. An upper end of stop 25 has a beveled edge 31 formed thereon which terminates at a distance "b" rearwardly of a rearward side 32 of plate 29 to aid in such downward movement of the blank onto conveyor 13. It should be noted that edge 31 is tapered upwardly and rearwardly to precisely guide the downward movements of the blank onto the conveyor.

After the blank has been moved upwardly to position $C_2$ in FIG. 3, a second air cylinder 33 is extended to engage an upper edge of the blank with a shuttle bar 34, secured to a rod 35 of the cylinder. Shuttle bar 34 has a notch 36 formed therein to precisely engage only the upper edge of the forwardmost blank with the aid of a stationary guide plate 37 which slidably receives an upper end of shuttle 34 thereon during the initial downward movement of the shuttle. Notch 36 also cooperates with a backup portion 38 of the shuttle to precisely capture and move the blank to position $C_3$ in FIG. 4.

It should be further noted in FIG. 4 that when the blank has moved to position $C_3$, onto conveyor 13, that adjacent panels $P_1$ and $P_2$, connected together at a score line $S_1$, are engaged by suction cups 39 and 40, respectively, in case opening station 12. The use of suction cups for the opening of paperboard cases and cartons is well known in the packaging arts, such as exemplified by U.S. Pat. No. 3,701,525. Therefore, details of the vacuum source and related control systems for drawing and releasing vacuums in cups 39 and 40 will not be described specifically for sake of brevity. Also, the conventional control systems for synchronizing the intermittent movement of conveyor 13, the actuation of air cylinders 28 and 33 as well as the other air cylinders employed in the apparatus, and interrelated actuators, will not be described in detail, since, per se, they do not comprise a part of this invention.

As shown in FIGS. 3 and 4, suction cup 39 is mounted on frame 20 by a parallelogram-type linkage 41 comprising a pair of links 42 pivotally interconnected between frame 20 and a bracket 43, having suction cup 39 adjustably mounted thereon. Bracket 43 is pivotally attached to a rod 44 of an air cylinder 45 whereby synchronized extension and retraction of the cylinder will move suction cup 39 between its retracted position illustrated in FIG. 3, whereat the vacuum thereof has been released, and its extended position shown in FIG. 4 wherein the suction cup engages panel $P_1$ and a vacuum is first drawn therein to momentarily hold the panel in the position illustrated, and then released.

Substantially simultaneously therewith, a vacuum will be drawn on suction cup 40 which pivots upwardly to engage and grasp panel $P_2$ and then pivots counterclockwise to a retracted position underlying conveyor 13, whereat the vacuum is released, as illustrated in FIG. 2. As further shown in FIG. 2, suction cup 40 is secured on a bracket assembly 46 which is pivotally mounted at 47 on a bracket 46', pivotally mounted on frame 21 by a pivot pin 47'. An air cylinder 48, mounted on frame 21, has a rod 49 suitably connected to bracket assembly 46 to pivot suction cup 40 in the above-described manner. It should be understood that pairs of suction cups 39 and 40 (see FIG. 1) are preferably employed, although additional cups and associated linkages and air cylinders could be employed in the apparatus, if so desired.

After the suction cups have released their hold on case C, conveyor 13 will again move to engage a pair of lugs 50, secured to chains 22 thereof, with panel $P_1$ to erect the case into rectangular form as shown in FIGS. 3 and 5. The intermittently-run conveyor will then move the case adjacent to article transfer and loading station 14 and flap positioning station 15, as illustrated in FIG. 5. Prior to stopping conveyor 13 and opening case C adjacent to article transfer and loading station 14, upper and lower flaps $F_1$ and $F_2$ on each side of the case will engage stationary plows 51 and 52, respectively, to spread the flaps apart, as illustrated in FIG. 5. Further movement of the case will engage each pair of flaps $F_1$ and $F_2$ on elongated plows 53 and 54, respectively, as illustrated in FIG. 6. At this point, the conveyor will stop momentarily to permit a plurality of articles A to be inserted into one open side of the case.

As further shown in FIGS. 1 and 6, the articles are moved into the case by a pusher plate 55, fully described in applicants' above-referenced U.S. patent application Ser. No. 134,703. This application further describes the function of a pair of flipper-type gates 56 which are pivotally mounted adjacent to conveyor 13 to each maintain an end flap $F_3$ in open, noninterfering relationship with the articles under the control of an air cylinder (not shown), the actuation of which is synchronized with the other machine operations.

After the articles have been inserted into the case, conveyor 13 will again start to move the filled case through case flap folding station 16. As mentioned above, suitable glue guns or rollers (not shown) may be arranged in a conventional manner in proximity to this station to apply an adhesive to the flaps prior to final sealing thereof. In the sequence of operations illustrated in FIGS. 8–10, it should be noted that leading flap $F_3$ on each side of the case is initially folded inwardly by a stationary plow bar 57, whereas each trailing flap $F_3'$ is folded inwardly by a pivotal plow bar 58. A standard crank mechanism 59 connects plow bar 58 to a rod 60 of an air cylinder 61 to effect the inward folding of flap $F_3'$ in timed relationship relative to the other folding steps. As suggested above, plow bars 57 and 58 are duplicated on the opposite side of conveyor 13 to fold-in the other two ends flaps $F_3$ and $F_3'$ in a like manner.

As shown in FIG. 9, continued movement of case C on conveyor 13 will engage each flap $F_2$ with a pivotal plow bar 62 which pivots forwardly against the flap to ensure that this flap is superimposed over flaps $F_3$ and $F_3'$ and held there by a stationary plow bar 62'. Plow bar 62 is mounted on a crank assembly 63 which is actuated by an air cylinder 64. As shown in FIG. 10, a forward edge of each flap $F_1$ will thereafter engage under a stationary plow bar 65 to complete the closure of the flaps. Upon leaving its holding position on flap $F_2$, plow bar 62 will, of course, be retracted away from conveyor 13 by air cylinder 64.

The case will then be moved through sealing station 17 (FIG. 1) to seal the flaps to ready the case for shipment purposes. As shown, the sealing station comprises a pair of endless belts 66, the linear movement of which is synchronized with conveyor 13. The vertically disposed belts may have inward pressure applied thereto by a plurality of vertical roller means 67 to ensure full sealing of the flaps and to compensate for any irregularities.

We claim:

1. In a case opening and sealing apparatus comprising a magazine having a plurality of flattened case blanks stacked in upstanding relationship therein, a conveyor underlying said magazine, and opening means for opening said case blanks, the improvement comprising shuttle means for sequentially (1) engaging a lower edge of a leading one of said case blanks to prevent removal thereof from said magazine, (2) moving said case blank upwardly to release the lower edge thereof from said magazine, and (3) pushing said case blank downwardly onto said conveyor, said shuttle means including a fixed first stop means secured at a forward end of said magazine for engaging a lower end of said case blank, and a fixed second stop means having a lower end disposed vertically above and closely adjacent to said first stop means for defining an opening therebetween for permitting downward movement of said case blank therethrough when said blank is pushed downwardly onto said conveyor, a rearward side of said second stop means engaging upper portions of said case blank being disposed forwardly in offset relationship relative to a rearward side of said first stop means engaging the lower end of said case blank whereby upward movement of said case blank will permit the lower edge thereof to snap forwardly over said first stop means for subsequent downward pushing thereof onto said conveyor.

2. The apparatus of claim 1 wherein said first stop means comprises a plate having a tapered upper edge formed thereon.

3. The apparatus of claim 1 wherein said shuttle means further includes means disposed below said magazine for engaging the lower edge of said case blank for moving it upwardly to release said edge from said magazine.

4. The apparatus of claim 3 wherein said shuttle means further includes means for engaging an upper edge of said case blank to push it downwardly onto said conveyor.

5. The apparatus of claim 4 wherein said lastmentioned means includes a reciprocal member having a notch formed on an upper end thereof to engage the upper edge of said case blank upon downward movement of said member.

6. The apparatus of claim 1 wherein said opening means includes a plurality of suction cups.

7. The apparatus of claim 6 wherein said suction cups includes first suction cup means, disposed below said magazine and said shuttle means, for engaging a first panel of said case blank when said case blank is pushed downwardly onto said conveyor and second suction cup means for moving from a first position below said conveyor to a second position engaging a second panel of said case blank and for thereafter moving away from said first suction cup means to open said case blank into tubular form.

8. The apparatus of claim 1 further including means for opening end flaps of said case blank to adapt it for insertion of articles therein.

9. The apparatus of claim 8 further including means for closing and sealing the end flaps of said case blank.

10. The apparatus of claim 1 further including a pair of vertically disposed endless belts disposed on either side of said conveyor and means for applying inward pressure to said belts to seal flaps of erected case blanks.

* * * * *